US005632406A

United States Patent [19]

Robbins, III

[11] Patent Number: 5,632,406

[45] Date of Patent: May 27, 1997

[54] SIDE WALL CONSTRUCTION FOR COLLAPSIBLE CONTAINERS

[76] Inventor: Edward S. Robbins, III, 2802 E. Avalon Ave., Muscle Shoals, Ala. 36661

[21] Appl. No.: 541,155

[22] Filed: Oct. 11, 1995

[51] Int. Cl.[6] ..... B65D 6/12

[52] U.S. Cl. ..... 220/666; 206/218; 220/8; 215/900

[58] Field of Search ..... 220/666, 667, 220/8; 206/218; 215/900

[56] References Cited

U.S. PATENT DOCUMENTS

| | | |
|---|---|---|
| 625,719 | 5/1899 | Crofford . |
| 640,418 | 1/1900 | Royer . |
| 1,040,652 | 10/1912 | Douglas . |
| 1,048,935 | 12/1912 | Brady . |
| 2,784,882 | 3/1957 | Du Bois . |
| 2,880,902 | 4/1959 | Owsen . |
| 2,893,167 | 7/1959 | Davidson . |
| 2,899,110 | 8/1959 | Parker . |
| 2,952,379 | 9/1960 | Potter . |
| 2,985,915 | 5/1961 | Winstead . |
| 3,143,429 | 8/1964 | Swanson et al. . |
| 3,156,383 | 11/1964 | Melli . |
| 3,220,544 | 11/1965 | Lovell . |
| 3,286,872 | 11/1966 | Burdick, Jr. . |
| 3,301,293 | 1/1967 | Santelli . |
| 3,326,421 | 6/1967 | Peace . |
| 3,329,298 | 7/1967 | Demas . |
| 3,394,018 | 7/1968 | Velonis et al. . |
| 3,467,283 | 9/1969 | Kinnavy . |
| 3,494,509 | 2/1970 | McGuire . |
| 3,578,415 | 5/1971 | Hiltz . |
| 3,608,268 | 9/1971 | Lauritzen . |
| 3,707,241 | 12/1972 | Taylor . |
| 3,804,663 | 4/1974 | Clark . |
| 3,864,771 | 2/1975 | Bauer et al. . |
| 3,875,941 | 4/1975 | Adair . |
| 3,939,888 | 2/1976 | Scarnato . |
| 4,087,024 | 5/1978 | Martin et al. . |
| 4,428,507 | 1/1984 | Sneider . |
| 4,456,134 | 6/1984 | Cooper . |
| 4,492,313 | 1/1985 | Touzani . |
| 4,706,829 | 11/1987 | Li . |
| 4,712,699 | 12/1987 | Lutz . |
| 4,734,288 | 3/1988 | Engstrom et al. . |
| 4,775,564 | 10/1988 | Shriver et al. . |
| 4,805,799 | 2/1989 | Robbins, III . |
| 4,815,615 | 3/1989 | Phlaphongphanich . |
| 4,836,970 | 6/1989 | Robbins, III . |
| 4,842,165 | 6/1989 | Van Coney . |
| 4,844,273 | 7/1989 | Hawkins . |
| 4,846,376 | 7/1989 | Palmer . |
| 4,865,211 | 9/1989 | Hollingsworth . |
| 4,875,576 | 10/1989 | Torgrimson et al. . |
| 4,892,126 | 1/1990 | Bucheler et al. . |
| 4,925,055 | 5/1990 | Robbins, III et al. . |
| 4,927,690 | 5/1990 | Welsh . |
| 4,930,644 | 6/1990 | Robbins, III . |
| 4,955,493 | 9/1990 | Touzani . |
| 4,979,628 | 12/1990 | Robbins, III . |

(List continued on next page.)

FOREIGN PATENT DOCUMENTS

| | | |
|---|---|---|
| 587701 | 8/1924 | France . |
| 1301970 | 8/1969 | Germany . |
| 2340967 | 3/1974 | Germany . |
| 3937456A | 5/1991 | Germany . |
| 4-102544 | 4/1992 | Japan . |
| 2109247 | 6/1983 | United Kingdom . |
| 2138525 | 10/1984 | United Kingdom . |
| WO88/05014 | 7/1988 | WIPO . |

*Primary Examiner*—Joseph Moy
*Attorney, Agent, or Firm*—Nixon & Vanderhye P.C.

[57] ABSTRACT

A collapsible container comprising a peripheral side wall; a closed bottom at a lower end of the peripheral side wall and an opening at an upper end of the peripheral side wall; the peripheral side wall having at least three axial sections, with at least one relatively thin section located axially between upper and lower relatively thick sections; wherein at a transition area between the relatively thin section and at least one of the upper and lower relatively thick sections, the peripheral side wall is shaped to include a sideways oriented, substantially S-shaped cross section.

11 Claims, 5 Drawing Sheets

U.S. PATENT DOCUMENTS 5,002,193 3/1991 Touzani .
5,027,963 7/1991 Robbins, III .
5,219,628 6/1993 Hathaway et al. .
5,226,551 7/1993 Robbins, III .
5,266,763 11/1993 Colombo .
5,300,748 4/1994 Colombo .

FIG. 3
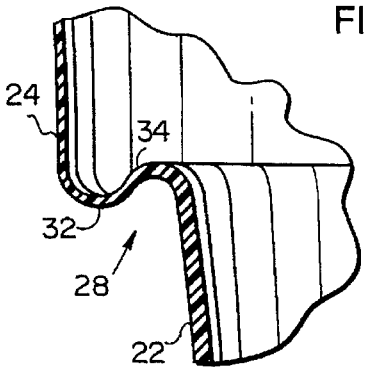
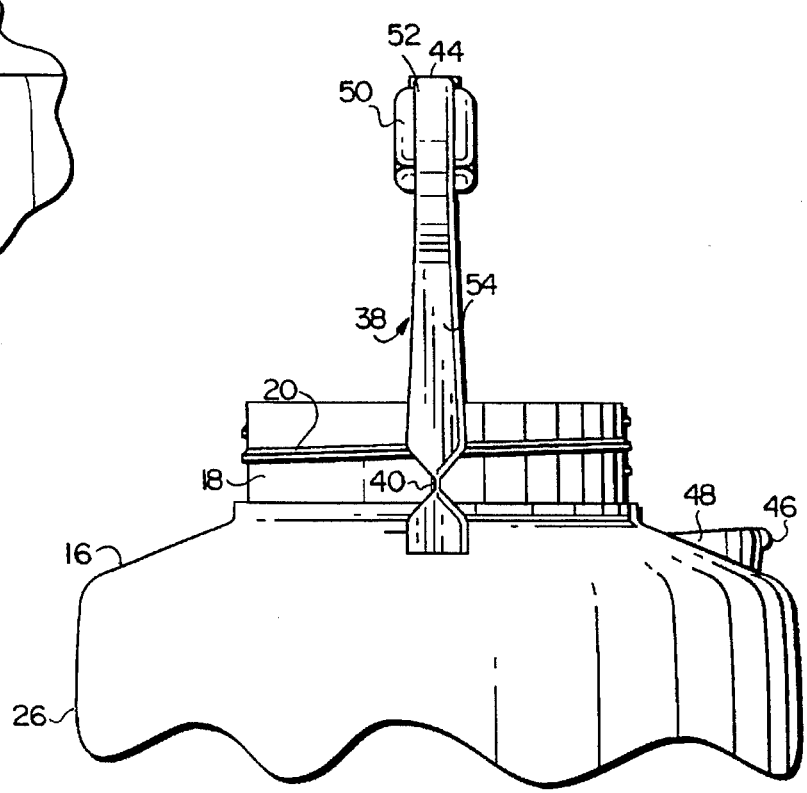
FIG. 4A
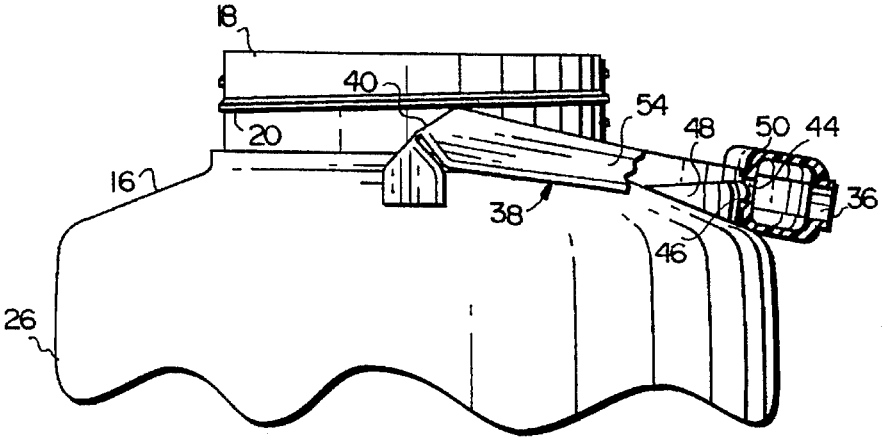
FIG. 4B

SIDE WALL CONSTRUCTION FOR COLLAPSIBLE CONTAINERS

TECHNICAL FIELD

This invention relates generally to collapsible plastic containers, and more specifically, to improved peripheral side wall constructions for such containers.

BACKGROUND PRIOR ART

Collapsible containers, drinking cups and the like are, of course, well known. For example, in applicant's own prior U.S. Pat. No. 4,930,644, a collapsible, thin film plastic container is disclosed wherein a major portion of the container side wall has a reduced wall thickness to permit random collapse of the side wall. In U.S. Pat. No. 4,865,211, a plastic bottle having a uniform wall thickness throughout the side wall, is configured to permit collapsing of the container through telescoping movement of one portion of the side wall into another portion of the side wall.

In U.S. Pat. No. 4,875,576, a container is disclosed wherein an intermediate portion of the side wall incorporates a bellows-type arrangement for facilitating collapse and extension of the container. The patent also discloses the use of helical creases which spiral or angle between first and second portions of the container side wall to facilitate collapsing action of the creased portion of the side wall.

In U.S. Pat. No. 4,873,100, a bi-stable, expandable plastic bottle is disclosed which incorporates a bellows-type side wall for movement between collapsed and extended positions.

In U.S. Pat. No. 2,880,902, a collapsible, drinking cup (or camera bellows) is disclosed wherein the side wall is composed of alternating thick and thin portions.

In U.S. Pat. Nos. 5,226,551 and 5,417,337, there are disclosed a variety of collapsible plastic containers incorporating peripheral side walls usually having at least three axial sections including an upper section, an intermediate section and a lower section. The intermediate section has a significantly reduced wall thickness permitting the lower section to be pushed upwardly into the upper section with the intermediate section reverse folded therebetween. In addition, the diameters of the intermediate section and at least part of the lower section are smaller than the upper section to facilitate the folding or collapsing process.

Of particular concern in collapsible container construction are the transition areas (or annular fold lines) between adjacent thick and thin sections of the peripheral side wall. This is because these areas often determine the ease or difficulty with which the collapsing/folding action is initiated. In addition, prior constructions have not been completely satisfactory in that cracking and fracture of the polymer can occur at the annular fold lines upon repeated collapsing and expansion movements. It will be appreciated that consumer acceptance depends on reliability, ease of use, cost, etc., and therefore, concerns about ease of use, reliability and durability must be addressed satisfactorily.

DISCLOSURE OF THE INVENTION

The principal object of this invention is to improve the prior collapsible container constructions in the '351 and '337 patents by incorporating improved transition or fold areas between adjacent thick and thin sections of the peripheral side walls of the containers.

It has now been discovered that the foldability or collapsibility of containers as described in my aforementioned U.S. Patents can be significantly enhanced by incorporating a transition geometry between axial side wall sections of alternating thick/thin configuration, which is substantially sideways S-shaped. In other words, in the transition area between, for example, the thin intermediate section and the thicker bottom section of the container side wall, the lowermost edge of the intermediate section (defined by a first radius) and the uppermost edge of the lower section (defined by a second radius) overlap such that when the two radiused areas are connected, a sideways S-shape results. This axial overlapping arrangement can be utilized at any fold line location along the axial length of the container, as well as at the upper neck or shoulder portion, where folding or collapsing action is to occur. Moreover, the shape of the container is not limited to those illustrated and described herein, and it should be understood that the invention is equally applicable to both single and multi-layer side wall constructions formed by extrusion and/or blow molding or any other plastics forming technique.

Another feature of the invention disclosed herein relates to a new, hollow handle which can be blow integrally with the container. Pinching off the legs of the handle adjacent the location where the handle joins the container provides an integral, living hinge which permits the handle to be moved between upright and folded-over positions.

Accordingly, in its broader aspects, the invention relates to a collapsible container comprising a peripheral side wall; a closed bottom at a lower end of the peripheral side wall and an opening at an upper end of the peripheral side wall; the peripheral side wall having at least three axial sections, with at least one relatively thin section located axially between upper and lower relatively thick sections; wherein at a transition area between the relatively thin section and at least one of the upper and lower relatively thick sections, the peripheral side wall is shaped to include a sideways oriented, substantially S-shaped cross-section.

BRIEF DESCRIPTION OF THE DRAWINGS

FIG. 3 is an enlarged detail taken from FIG. 1;

FIG. 4A is a partial side elevation of the container illustrated in FIG. 1, and rotated 90°;

FIG. 4B is a partial side elevation similar to FIG. 4A, but with a handle shown in a folded position;

BEST MODE FOR CARRYING OUT THE INVENTION

Figure 1:
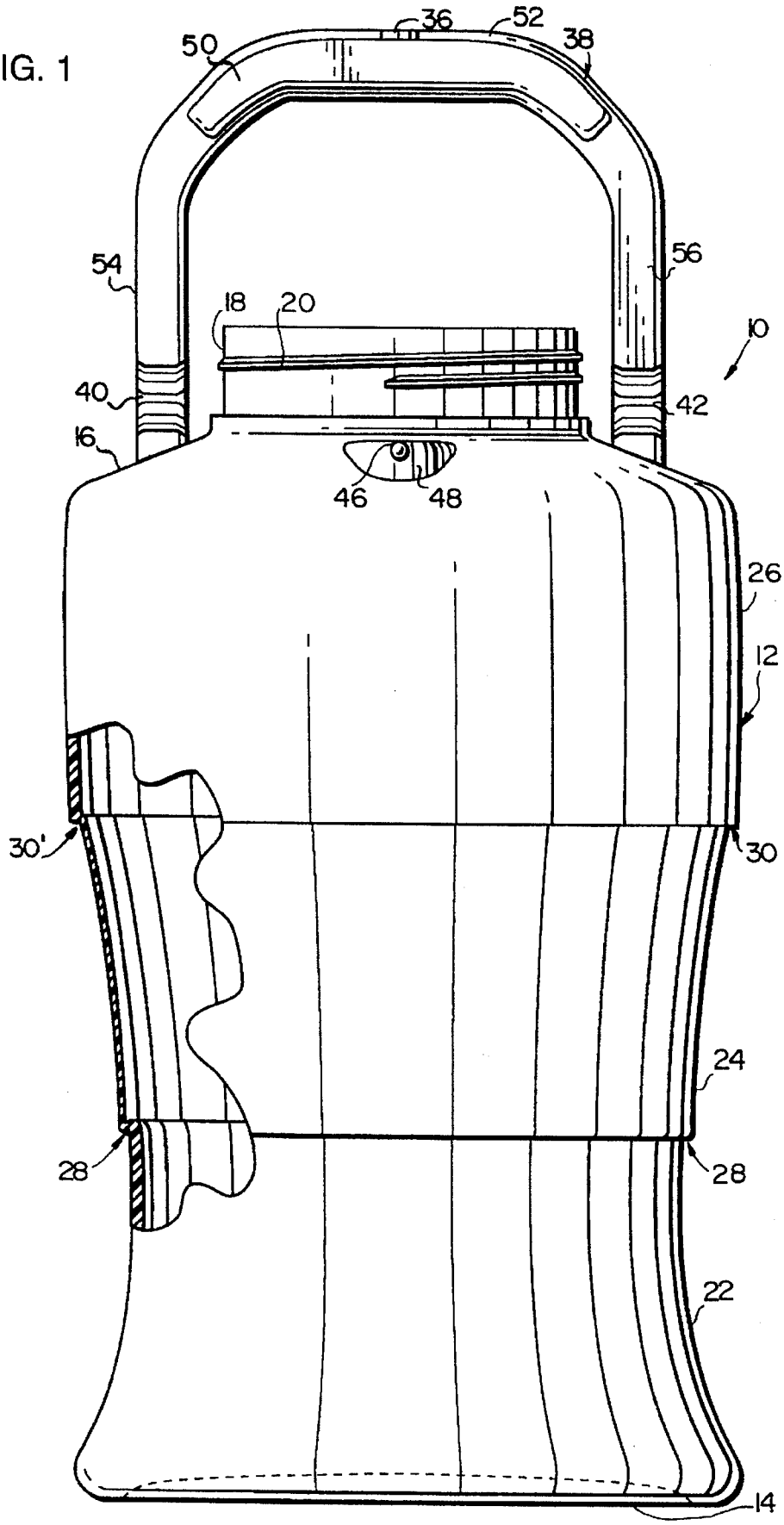
FIG. 1 is a side elevation, partly in section, illustrating a container side wall incorporating the improved transition or fold line area in accordance with this invention.
Figure 2:
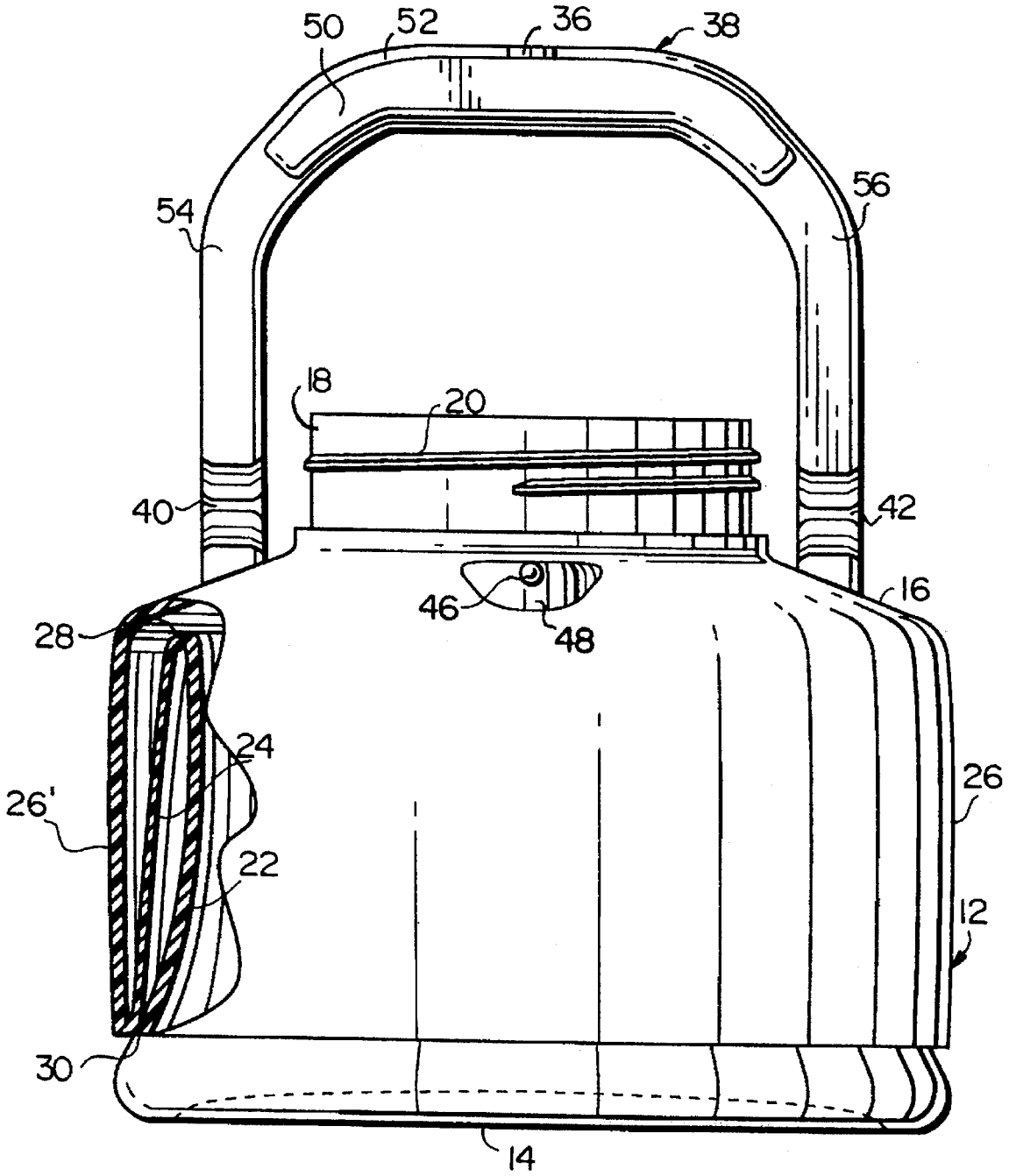
FIG. 2 is a side elevation, partly in section, of the container illustrated in FIG. 1, but in a folded or collapsed condition.

With reference now to FIGS. 1 and 2, the container 10 is shown in a fully extended condition (FIG. 1) and fully collapsed condition (FIG. 2). The container includes a peripheral side wall 12, a bottom 14 at a lower end, and a neck or shoulder 16 at an upper end. The neck or shoulder 16 terminates at an upstanding rim 18 which is formed with an external screw thread 20 adapted to receive a screw threaded conventional closure. Of course, other closure types may be used as desired.

The peripheral side wall 12 is formed with three axially spaced sections: a lower section 22, an intermediate section 24 and an upper section 26 which joins with the neck or shoulder 16.

A significant aspect of this invention concerns the annular transition areas (or fold lines) 28 and 30 between the lower section 22 and intermediate section 24, and between the intermediate section 24 and upper section 26, respectively.

These transition areas or fold lines 28, 30 join side wall sections of different wall thickness, enabling the container to be folded or collapsed to the position shown in FIG. 2, where the lower section 22 is pushed upwardly into the upper section 26, with the intermediate section 24 reverse folded therebetween. Except for the specific transition area geometry described in detail below, the overall side wall construction and the manner of folding is substantially as described in U.S. Pat. Nos. 5,226,551 and 5,417,337.

Referring now to FIG. 3, the annular transition or fold line 28 is shown in detail, with the container wall in its fully extended condition. It is important to note that the lowermost radiused edge 32 of the intermediate section 24 extends below the uppermost radiused edge 34 of the lower section 22, i.e., the fold line edges axially overlap. In an exemplary embodiment, edges 32 and 34 may have radii of about 0.025 inch, with the centers vertically offset by about 0.025 inch and laterally offset by about 0.042 inch. Wall thicknesses in the transition area may range from about 0.015 inch in the area of edge 32, to about 0.010 inch in the area of edge 34. In a typical embodiment, the intermediate side wall section thickness is about 0.008 inch and the upper and lower side wall sections may have a thickness of about 0.030 inch or more.

Generally, the thicknesses of the side wall sections 22, 24, 26, including the annular transition areas or fold lines 28, 30, and the transition edge areas 32, 34 may vary according to the location of the fold line feature, container size and container geometry. In this regard, the examples shown in the various Figures are exemplary only and not limiting. Indeed, the transition geometry can appear at any area on the container requiring folding, but not limited to the axially aligned upper, intermediate and lower side wall sections.

For the container shown in FIG. 1, the above described transition area or fold line 28 is most helpful at the described and illustrated intermediate section-to-lower section interface (i.e., between sections 22 and 24) since it is here that the collapsing or folding action is initiated. Folding and collapsing action is made easier by the above described transition area. More importantly, however, the sideways S-shaped geometry eliminates cracking and fracture of the polymer at the fold lines, thus preventing premature failure of the product and hence improving quality and service life. It should be noted, however, that a similar overlapping transition or fold line may be incorporated at the intermediate section-to-upper section transition area or fold line 30.

Other features of the container will now be described. The container itself, with the exception of any separable closure, is formed as a one-piece, extrusion blow molded unit, with air introduced into the preform through a hole 36 in the integral handle 38.

The handle 38 is of generally inverted U-shape, with a larger cross-section gripping portion 50 located generally within the web 52 connecting the legs 54, 56. After blow molding, the handle 38 is pinched, creating living hinges 40, 42 which permit the handle 38 to be moved from the upright position shown in FIGS. 1, 2 and 4A to the folded-over position shown in FIG. 4B. When folded over, a hole 44 opposite the blow hole 36 locks into a dimple 46 formed on a projection 48 molded into the sloping neck or shoulder 16 of the container 10.

Figure 5:
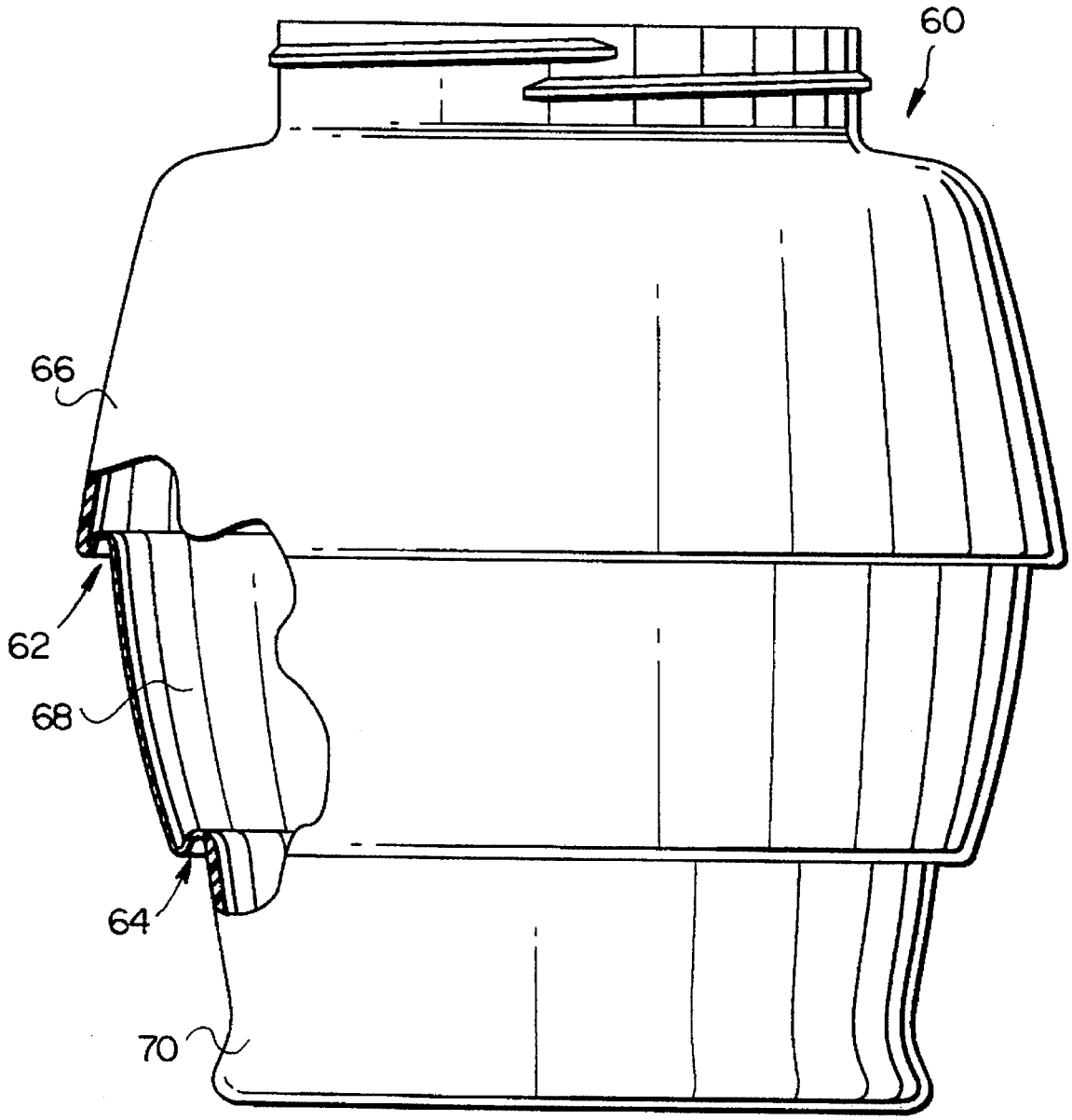
FIG. 5 is a side elevation, partly in section illustrating another container incorporating the improved side wall of the invention.

Referring to FIG. 5, a container 60 illustrates overlapping sideways S-shaped transition areas or fold lines 62, 64 similar to those described above, incorporated at each interface between relatively thick, thin and thick side wall sections 66, 68 and 70, respectively. More specifically, a sharply defined sideways S-curve fold line 62 is formed at the interface between relatively thick upper side wall portion 66 (e.g., about 0.040 inch) and relatively thin intermediate section 68 (e.g., about 0.006 inch); and a similar sideways S-curve configuration 64 is formed at the interface between relatively thin intermediate section 68 and the relatively thick lower side wall portion 70. Note that, in this embodiment, the degree of overlap between side wall sections at the annular transition areas or fold lines 62 and 64 is even greater than in the embodiment illustrated in FIGS. 1–4. Thicknesses in the radiused portions of the transition area may be similar to the embodiment shown in FIGS. 1–4, but are not limited thereto.

Figure 6:
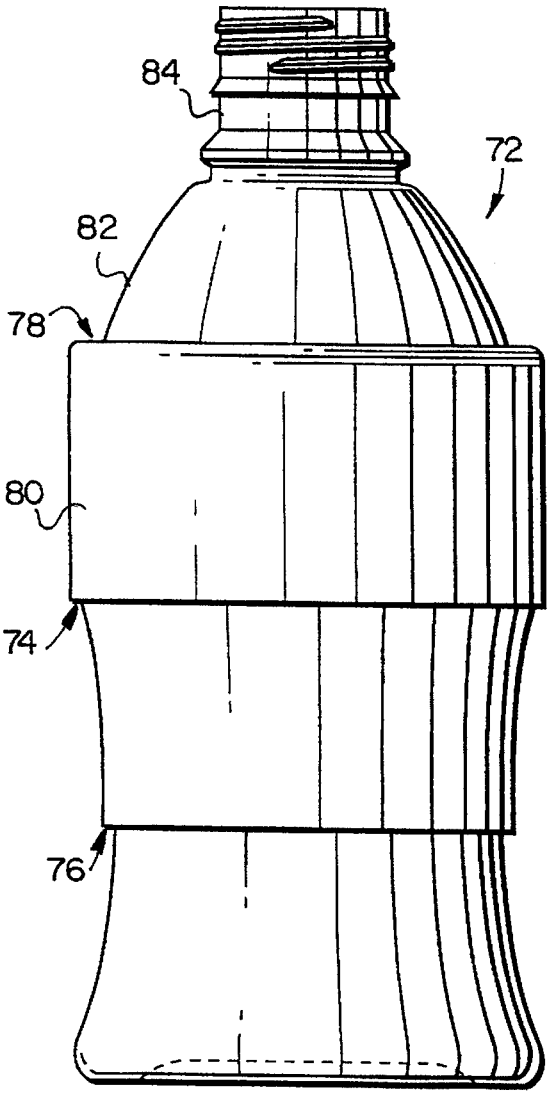
FIG. 6 is a side elevation of still another container incorporating the improved side wall of this invention.
Figure 7:
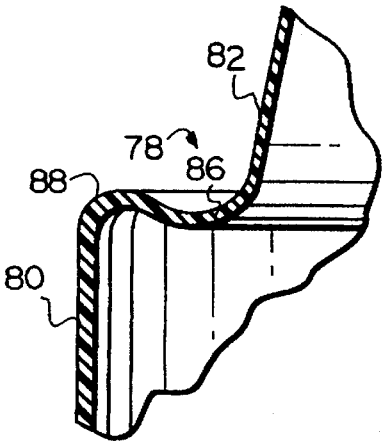
FIG. 7 is an enlarged detail taken from FIG. 6.

Referring now to FIGS. 6 and 7, another container 72 is illustrated which incorporates sideways S-shaped configurations at transition areas or fold lines 74, 76. In addition, a sideways S-shaped configuration 78 is formed between the relatively thick upper side wall section 80, and a relatively thin shoulder 82, facilitating collapse of the shoulder 82 and rim 84 into the upper side wall section 78. In this embodiment, dimensions may be as follows the lowermost edge 86 of the transition area 78 may have a radius of about 0.77 inch while the uppermost edge 88 of the same transition area 78 may have a radius of about 0.061 inch with the centers vertically offset by about 0.109 inch and laterally offset by about 0.084 inch. Adjacent wall thicknesses may be about 0.018 inch for shoulder 82 and about 0.040 inch for upper side wall section 80, and about 0.010 in the transition area 78. Again, the thicknesses and radii in the transition or fold areas may vary according to location, container geometry and size, and the transition or fold areas can appear anywhere on the container where a folding feature is desired.

It should also be understood that the transition geometry described herein is also applicable to container side walls having multiple layers (formed by coextrusion and blow molding for example) of plastic material. The relative thickness of each layer will be determined by materials and specific container applications.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A collapsible container comprising:

a peripheral side wall movable between extended and collapsed conditions;

a dosed bottom at a lower end of the peripheral side wall and an opening at an upper end of the peripheral side wall; said peripheral side wall having at least three axial sections, with at least one relatively thin section located axially between upper and lower relatively thick sections; wherein at a transition area between the relatively thin section and at least one of the upper and lower relatively thick sections, the peripheral side wall is shaped to include a sideways oriented, substantially S-shaped cross section when the container is in its extended condition, and wherein said substantially S-shaped cross section includes a first radius and a second radius, and wherein said first and second radii have different wall thicknesses.

2. The collapsible container of claim 1 wherein said first radius is located at a lowermost edge of the intermediate side wall section and said second radius is located at an uppermost edge of the lower side wall section.

3. The collapsible container of claim 1 wherein the first radius extends below the second radius when the side wall is in the extended condition.

4. The collapsible container of claim 2 wherein another substantially S-shaped cross section is provided at a transition area between the relatively thin section and the upper relatively thick section.

5. The collapsible container of claim 1 wherein said first and second radii are substantially identical.

6. The collapsible container of claim 1 wherein said first and second radii are laterally and vertically offset relative to each other.

7. The container of claim 1 wherein said peripheral side wall is shaped to permit the lower side wall section to be pushed into said upper side wall section with said intermediate side wall section reverse folded therebetween.

8. The container of claim 1 including an integral handle formed in a shoulder connecting said upper side wall section and a rim defining said opening, said handle pivotable between upright and folded-over positions.

9. The container of claim 8 and including cooperable surface elements enabling the handle to be releasably secured to the shoulder in the folded-over position.

10. The container of claim 8 wherein said handle includes a pair of legs incorporating integral hinges.

11. The container of claim 1 wherein a relatively thin shoulder extends between the relatively thick upper portion and a relatively thick rim, and wherein another substantially sideways S-shaped cross section is formed between said relatively thick upper portion and said relatively thin shoulder.

* * * * *